US008196710B2

(12) United States Patent
Hiramatsu

(10) Patent No.: US 8,196,710 B2
(45) Date of Patent: Jun. 12, 2012

(54) OIL PAN STRUCTURE

(75) Inventor: Chiaki Hiramatsu, Aichi-ken (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 624 days.

(21) Appl. No.: 12/269,303

(22) Filed: Nov. 12, 2008

(65) Prior Publication Data

US 2009/0145695 A1 Jun. 11, 2009

(30) Foreign Application Priority Data

Dec. 11, 2007 (JP) ..... 2007-319676

(51) Int. Cl.
*F16N 31/00* (2006.01)

(52) U.S. Cl. ..... 184/106

(58) Field of Classification Search ..... 184/106; 123/196

See application file for complete search history.

(56) References Cited

U.S. PATENT DOCUMENTS

| | | | | |
|---|---|---|---|---|
| 4,825,825 | A * | 5/1989 | Chino et al. | 123/195 C |
| 4,995,971 | A * | 2/1991 | Droste et al. | 210/167.03 |
| 5,653,205 | A * | 8/1997 | Ozeki | 123/195 C |
| 6,584,950 | B1 * | 7/2003 | Cunningham | 123/195 C |
| 6,640,767 | B2 * | 11/2003 | Kato et al. | 123/195 C |
| 7,171,937 | B2 * | 2/2007 | Hada et al. | 123/195 C |
| 2002/0100641 | A1 * | 8/2002 | Osman | 184/106 |
| 2008/0066982 | A1 * | 3/2008 | Kobayashi et al. | 180/69.1 |

FOREIGN PATENT DOCUMENTS

| | | | |
|---|---|---|---|
| GB | 2437089 | A * | 4/2006 |
| JP | 49-002925 | | 1/1974 |
| JP | 52-030535 | | 3/1977 |
| JP | 10-176515 | | 6/1998 |
| JP | 2001-152825 | | 6/2001 |
| JP | 2004-218582 | | 8/2004 |
| JP | 2004-218582 | A | 8/2004 |
| JP | 2006-125201 | | 5/2006 |

OTHER PUBLICATIONS

English language Abstract and translation JP 2004-218582 A.

Japan Office action, dated Aug. 23, 2011 along with an english translation thereof.

* cited by examiner

*Primary Examiner* — Michael Mansen
*Assistant Examiner* — Michael Riegelman
(74) *Attorney, Agent, or Firm* — Greenblum & Bernstein P.L.C.

(57) ABSTRACT

An oil pan structure is provided that can prevent overheating when the temperature of oil is high, and can rapidly raise the temperature when the temperature of the oil is low. The oil pan structure includes: an oil pan main body; a partitioning wall that partitions the inside of the oil pan main body into a first area and a second area; a plate-shaped baffle plate that is provided at an upper portion of the oil pan main body and inclines downward from the first area toward the second area. The oil pan structure further includes: an oil retaining portion at a lower portion of the second area and an oil cooling portion at a lower portion of the first area, at the bottom wall of the oil pan main body; an upper communication opening that communicates an upper surface side and a lower surface side thereof in the baffle plate; a lower communication opening at a lower end side of the partitioning wall that communicates the first area and the second area as well as causes oil that has fallen into the first area after passing through the upper communication opening to flow into the second area via the oil cooling portion.

19 Claims, 5 Drawing Sheets

OIL PAN STRUCTURE

BACKGROUND OF THE INVENTION

1. Field of the Invention

The present invention relates to an oil pan structure, and in particular, relates to an oil pan structure that can prevent overheating when an oil temperature is high by providing, at a lower portion of the oil pan, a cooling portion through which substantially an entire quantity of oil that is fed into an internal combustion engine passes, and that can quickly raise the oil temperature when it is low.

2. Description of the Related Art

In recent years, temperature control of oil that is used in lubrication of internal combustion engines has become important. This is because the temperature and the viscosity of oil are correlated, and the viscosity of the oil must be maintained within a constant range in order to maintain a constant oil film thickness. In addition, the oil that is discharged from the lubrication paths of the internal combustion engine during use normally acquires a temperature that is higher than a suitable temperature range, and thus cooling the oil so that the temperature thereof falls within the suitable temperature range before flowing back into the lubrication paths is being investigated (refer, for example, to Patent Document 1).

In Patent Document 1, an oil pan is disclosed that has a double-walled structure formed from an inner wall and an outer wall. In the oil pan, a slope portion inclining downward toward an oil strainer that is in the inner wall is formed at a portion of the inner wall, and a number of communication openings that communicate the inside portion of the inner wall and a space between the inner and outer walls are provided in the slope portion. In the oil pan, a circulation path of the oil is changed depending on a difference in the viscosity of the oil due to the oil temperature, whereby a rise in the oil temperature is hastened during warm-up, while a rise in the oil temperature is suppressed after warm-up.

However, in Patent Document 1, cooled is only oil that has flown between the inner and outer walls and come into contact with the outer wall. Oil that has been drawn back into the oil strainer without coming into contact with the outer wall is also present, and thus it is not possible to suppress a rise in the temperature of such oil.

Patent Document 1: Japanese Patent Application Publication No. JP-A-2004-218582

SUMMARY OF THE INVENTION

Problems to be Solved by the Invention

In consideration of the circumstances described above, the present invention relates to an oil pan structure that can prevent overheating when an oil temperature is high by providing, at a lower portion of the oil pan, a cooling portion through which substantially an entire quantity of oil that is fed into an internal combustion engine passes, and that can quickly raise the oil temperature when it is low.

Means for Solving Problem

The present invention is as follows.

1. An oil pan structure, comprising:

an oil pan main body;

a partitioning wall that is provided inside the oil pan main body and that partitions the inside of the oil pan main body into a first area and a second area; and a plate-shaped baffle plate that is provided inside the oil pan main body at least above the first area, and that inclines downward from the first area toward the second area; wherein an oil retaining portion is provided at a part of a bottom wall of the oil pan main body, which is a lower portion of the second area at which an oil suction opening is arranged;

an oil cooling portion is provided at a part of the bottom wall of the oil pan main body, which is a lower portion of the first area;

an upper communication opening that communicates an upper surface side and a lower surface side of the baffle plate is provided in the baffle plate; and a lower communication opening is provided at a lower end side of the partitioning wall, the lower communication opening communicating the first area and the second area as well as causing oil that has fallen into the first area after passing through the upper communication opening to flow into the second area via the oil cooling portion.

2. The oil pan structure according to 1 above, wherein the oil cooling portion includes a groove portion that extends from the first area toward the oil retaining portion.
3. The oil pan structure according to 1 above, wherein a part of the bottom wall that corresponds to the second area has a heat insulating function.
4. The oil pan structure according to 1 above, wherein a ribbed heat dissipating plate is provided on an outer side of the bottom wall.
5. The oil pan structure according to 4 above, wherein the heat dissipating plate is provided on an outer side of a part of the bottom wall that corresponds to the lower portion of the first area.
6. The oil pan structure according to 1 above, wherein the first area is provided at least on both sides of the second area.
7. The oil pan structure according to 1 above, wherein a cover member is provided above the baffle plate inside the oil pan main body so as to cover a space above the second area.
8. The oil pan structure according to 7 above, wherein the cover member inclines downward from the second area toward the first area.
9. The oil pan structure according to 2 above, wherein a part of the bottom wall that corresponds to the second area has a heat insulating function.
10. The oil pan structure according to 9 above, wherein a ribbed heat dissipating plate is provided on an outer side of the bottom wall.
11. The oil pan structure according to 10 above, wherein the heat dissipating plate is provided on an outer side of a part of the bottom wall that corresponds to the lower portion of the first area.
12. The oil pan structure according to 11 above, wherein the first area is provided at least on both sides of the second area.
13. The oil pan structure according to 12 above, wherein a cover member is provided above the baffle plate inside the oil pan main body so as to cover a space above the second area.
14. The oil pan structure according to 13 above, wherein the cover member inclines downward from the second area toward the first area.
15. The oil pan structure according to 2 above, wherein the first area is provided at least on both sides of the second area.
16. The oil pan structure according to 15 above, wherein a cover member is provided above the baffle plate inside the oil pan main body so as to cover a space above the second area.

17. The oil pan structure according to 16 above, wherein the cover member inclines downward from the second area toward the first area.
18. The oil pan structure according to 12 above, wherein a cover member is provided above the baffle plate inside the oil pan main body so as to cover a space above the second area.
19. The oil pan structure according to 18 above, wherein the cover member inclines downward from the second area toward the first area.

Effect of the Invention

According to the oil pan structure of the present invention, when returning oil from the internal combustion engine that has fallen onto the baffle plate has a high temperature, the oil has a comparatively low viscosity, and thus, the oil passes through the upper communication opening provided in the baffle plate and then transits the bottom wall of the oil pan main body after falling into the first area. The heat of the oil is dissipated by coming into contact with the oil cooling portion that is provided at the bottom wall, and the oil passes through the lower communication opening at a lower end side of the partitioning wall to reach the second area. Then, the oil is drawn into the oil suction opening. In addition, when the returning oil from the internal combustion engine has a low temperature, the oil has a comparatively high viscosity, and thus the oil does not readily pass through the upper communication opening. The oil continues flowing along the incline of the baffle plate, reaches the second area after falling from an end portion of the baffle plate, and is drawn into the oil suction opening without transiting the oil cooling portion. In this manner, when the temperature of the oil is high, the oil transits the bottom wall of the oil pan main body so that the heat of the oil is dissipated by coming into contact with the oil cooling portion. Thus, the heat of the high-temperature oil can be efficiently dissipated. In contrast, when the temperature of the oil is low, the oil is drawn into the oil suction opening without being cooled, and the circulated quantity of oil is reduced by prioritizing the circulation of the oil in the second area. Thus, the temperature of the low-temperature oil can be rapidly raised, and it is possible to realize the early warm-up of the internal combustion engine.

Moreover, in the case in which the oil cooling portion includes a groove portion that extends from the first area toward the oil retaining portion, a surface area of the oil cooling portion, with which the oil that has passed through the upper communication opening and fallen into the first area comes into contact, becomes large. Therefore, the heat of the high-temperature oil can be efficiently dissipated.

Furthermore, in the case in which the part of the bottom wall of the oil pan main body that corresponds to the lower portion of the second area includes a heat insulating function, the heat of the oil when the oil has a low temperature does not readily dissipate even after coming into contact with the bottom wall at the lower portion of the second area. Thus, the temperature of the low-temperature oil can be raised even more rapidly, and it is possible to realize an even earlier warm-up of the internal combustion engine.

In addition, in the case in which a ribbed heat dissipating plate is provided on the outer side of the bottom wall of the oil pan main body, heat dissipation effect on the high-temperature oil that passes through the upper communication opening and falls into the first area can be further improved.

Furthermore, in the case in which the first area is provided on at least both sides of the second area, the oil retaining portion, which has the oil suction opening disposed there-above, is disposed at a center portion of oil paths that are provided on both sides. Therefore, the oil is readily guided to the oil retaining portion.

In addition, in the case in which the cover member is provided above the baffle plate, the high-temperature returning oil from the internal combustion engine can be prevented from falling directly into the second area.

Furthermore, in the case in which the cover member inclines downward from the second area toward the first area, it is possible to reliably guide the high-temperature oil to the oil cooling portion.

BRIEF DESCRIPTION OF THE DRAWINGS

FIG. 1A shows a longitudinal cross-sectional view, and FIG. 1B shows a cross-sectional view along line I-I in FIG. 1A;

FIG. 2A shows a configuration consisting of grooves recessed from the inside, and FIG. 2B shows a mode consisting of grooves formed between ribs that project toward the inside;

FIG. 3A shows a longitudinal cross-sectional view and FIG. 3B shows a cross-sectional view along line II-II in FIG. 3A.

FIG. 4A shows a longitudinal cross-sectional view and FIG. 4B shows a cross-sectional view along line III-III in FIG. 4A; FIG. 5A shows a longitudinal cross-sectional view and FIG. 5B shows a cross-sectional view along line IV-IV in FIG. 5A

DESCRIPTION OF REFERENCE NUMERALS AND SIGNS

Figure 1A:
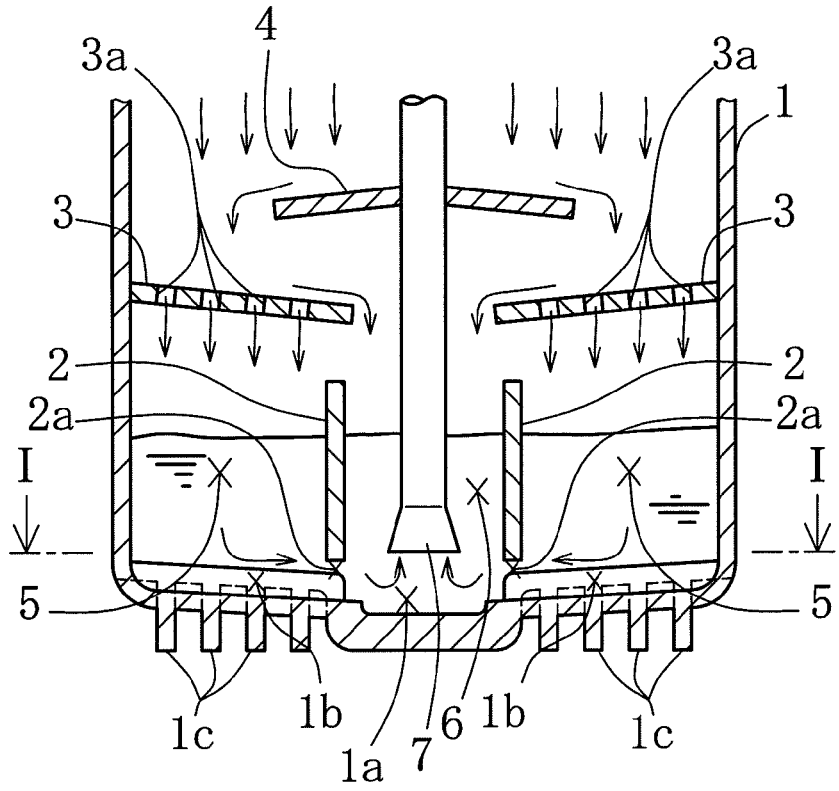
FIG. 1A and FIG. 1B show cross-sectional views of the oil pan structure of an embodiment, where

1, 11, 21, 31, 41; oil pan main body, 1*a*, 21*a*, 31*a*, 41*a*; oil retaining portion, 1*b*, 11*b*, 21*b*, 31*b*, 41*b*; oil cooling portion, 1*c*; heat dissipating fin, 2, 32, 42; partitioning wall, 2*a*; lower communication opening, 3; baffle plate, 3*a*; upper communication opening, 4; umbrella portion, 5, 35, 45; first area, 6, 36, 46; second area and 7; oil suction opening.

DETAILED DESCRIPTION OF THE PREFERRED EMBODIMENTS

An oil pan structure according to the present invention is provided with an oil pan main body, a partitioning wall, and a baffle plate that will be described below.

The structure, shape, material and the like of the "oil pan main body" described above are not limited in particular, provided that the oil pan main body retains oil returning from an internal combustion engine. Examples of the material for the oil pan main body include metals such as iron and aluminum, resins and the like. An oil retaining portion and an oil cooling portion, which will be described below, are provided at a bottom wall of the oil pan main body. From the viewpoint of heat dissipation characteristics of the oil, the oil pan main body is preferably made of a metal, which is a material with high heat conductivity.

The structure, shape, material and the like of the "partitioning wall" described above are not limited in particular, provided that the partitioning wall is provided inside the oil pan main body and partition the inside of the oil pan main body into a first area and a second area. Examples of the material for the partitioning wall include metals such as iron and aluminum, resins and the like. In addition, examples of the partitioning mode for the partitioning wall include (1) a mode in which the inside of the oil pan main body is serially partitioned into three chambers by using two plate-shaped partitioning walls such that the middle portion and adjacent portions on both sides thereof are defined as a second area and first areas, respectively (refer to FIG. 1A and FIG. 1B); (2) a mode in which the inside of the oil pan main body is partitioned into a first area and a second area, which are adjacent to each other side by side, by using one plate-shaped partitioning wall (refer to FIG. 4A and FIG. 4B); and (3) a mode in which the inside of the oil pan main body is partitioned, by using a cylindrical partitioning wall, into a first area that is the outside of the partitioning wall and a second area that is the inside of the partitioning wall (refer to FIG. 5A and FIG. 5B).

Note that a lower communication opening, which will be described later, is provided at a lower end side of the partitioning wall described above, whereby the first area and the second area are communicated. In addition, an oil suction opening is disposed at the second area.

The structure, material and the like of the "baffle plate" described above are not limited in particular, provided that the baffle plate is provided inside the oil pan main body at least above the first area and has a plate-shape that inclines downward from the first area toward the second area. An upper communication opening, which will be described later, is provided in the baffle plate.

The configuration and the like of the "oil retaining portion" described above are not limited in particular, provided that the oil retaining portion is provided at a part of the bottom wall of the oil pan main body that corresponds to the lower portion of the second area at which the oil suction opening is provided. The bottom surface of the oil retaining portion is normally the lowest surface in the oil pan main body, and the returning oil from the internal combustion engine that has fallen inside the oil pan main body is gathered there. In addition, the gathered returning oil is drawn in by the oil suction opening that is arranged at a predetermined position above the oil retaining portion, and is fed back to the lubricated portions via an oil pump.

The configuration and the like of the "oil cooling portion" described above are not limited in particular, provided that the oil cooling portion is provided at a part of the bottom wall of the oil pan main body that correspond to the lower portion of the first area described above. The oil cooling portion may include groove portions that extend from the first area toward the oil retaining portion. In addition, examples of the configuration of the groove portions include grooves that are provided by recessing the bottom wall from the inside (refer to FIG. 2A) or grooves in which the bottom wall projects in a ribbed shape toward the inside such that the grooves are defined between each of the ribs (refer to FIG. 2B).

The shape, number, and layout of the "upper communication opening" are not limited in particular, provided that the upper communication opening communicates the upper surface side and the lower surface side of the baffle plate. In the upper communication opening, based on changes in the viscosity due to changes in the temperature of the returning oil from the internal combustion engine that has fallen onto the baffle plate, the passage condition of the oil changes. Examples of the shape of the upper communication opening include a through hole, a slit and the like.

Note that the expression "the passage condition of the oil changes" denotes a state in which the oil does not readily pass through the upper communication opening when the temperature of the returning oil from the internal combustion engine that has fallen onto the baffle plates is less than a predetermined value, and a state in which the oil readily passes through the upper communication opening when the temperature of the returning oil is equal to or greater than a predetermined value. A freely chosen numerical value can be set for the predetermined value according to the type of use of the oil and the like, for example.

Examples of the state in which the oil does not readily pass through the upper communication openings include a state in which 80% or more (preferably, 90% or more) of the quantity of the returning oil does not pass through the upper communication openings. Meanwhile, examples of the state in which the oil readily passes through the upper communication openings include a state in which 80% or more (preferably 90% or more) of the quantity of the returning oil passes through the upper communication openings.

The shape, layout and the like of the "lower communication opening" are not limited in particular, provided that the lower communication opening is provided at a lower end side of the partitioning wall, communicates the first area and the second area, and causes the returning oil from the internal combustion engine that has fallen into the first area after passing through the upper communication opening to flow into the second area via the oil cooling portion described above. Examples of the lower communication opening include a through hole that is provided in the partitioning wall and an open space that is provided under the partitioning wall.

Here, for example, in the oil pan main body, a ribbed heat dissipating plate may be provided on the outer side of the bottom wall. In particular, the heat dissipating plate is preferably provided at a part of the bottom wall that corresponds to the lower portion of the first area. This is because the high-temperature oil that has fallen into the first area can be more efficiently cooled.

In addition, the oil pan main body may include, for example, a heat insulating function at a part of the bottom wall that corresponds to the second area. With this function, the heat of the low-temperature oil is not readily dissipated even when coming into contact with the bottom wall at the lower portion of the second area and the temperature of the low-temperature oil can be raised rapidly. Examples of the configuration having the heat insulating function include a configuration that consists of a heat insulating structure such as a thick-walled structure or a double-walled structure and a configuration in which a heat insulating material is attached to the outer surface side and the like.

The oil pan structure may be further provided with a cover member above the baffle plate inside the oil pan main body so as to cover the space above the second area. With this cover member, the high-temperature returning oil can be prevented from falling directly into the second area and thus it is possible to reliably guide the oil to the oil cooling portion.

The structure, shape, material, and the like of the "cover member" are not limited in particular, provided that the cover member guides the returning oil, which tends to fall directly into the second area, to fall onto the baffle plate. The cover members may be provided so as to incline downward from the second area toward the first area.

Embodiments

Below, an oil pan structure of the present invention will be explained in detail using embodiments, with reference to the drawings. Note that an oil pan structure that is provided at a lower portion of an internal combustion engine is illustrated as the oil pan structure of the present embodiment.

(1) Configuration of the Oil Pan Structure

Figure 1B:
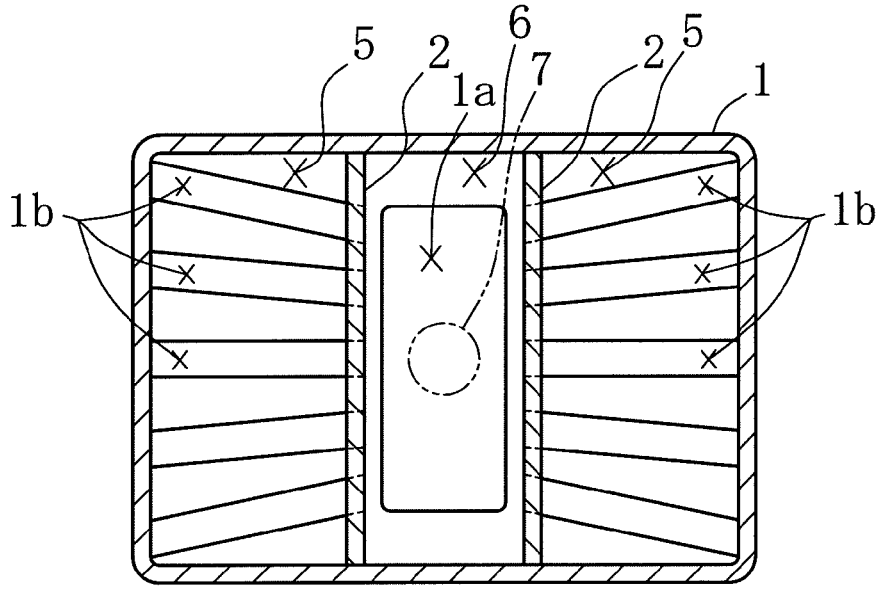
Figure 2A:
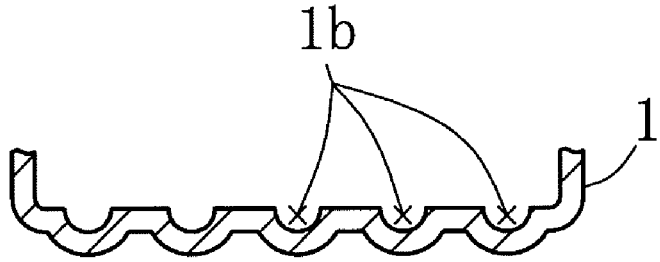
FIG. 2A and FIG. 2B show longitudinal cross-sectional views for explaining the oil cooling portions, where

As shown in FIGS. 1A and 1B, the oil pan structure of the present embodiment is provided with an oil pan main body 1. In the oil pan main body 1, two plate-shaped partitioning walls 2 are provided, and both ends thereof are attached to side walls of the oil pan main body 1. The inside of the oil pan main body 1 is partitioned, by the two partitioning walls 2, into a second area 6 between the two partitioning walls 2 and first areas 5 on both sides of the second area 6, such that the volume ratio between the first areas 5 and the second area 6 is about 3:1. An oil suction opening 7, which is provided with an oil strainer at a distal end thereof, is arranged in the second area 6. An oil retaining portion 1*a* is formed at a part of a bottom wall of the oil pan main body 1 that corresponds to a lower portion of the second area 6. As shown in FIG. 1A and FIG. 2A, a number of groove-shaped oil cooling portions 1*b*, which are provided so as to be recessed from the inside, are formed at a part of the bottom wall that corresponds to lower portions of the first areas 5, and extend toward the oil retaining portion 1*a* to portions under the partitioning walls 2. Moreover, lower communication openings 2*a* are formed at lower end sides of the partitioning walls 2, by which the first areas 5 and the second area 6 are communicated. Furthermore, a number of heat dissipating fins 1*c* (exemplified as "heat dissipating plates" according to the present invention) are formed on an outer surface side of parts of the bottom wall of the oil pan main body 1 that coincide with the lower portions of the first areas 5. In addition, a part of the bottom wall of the oil pan main body 1 that corresponds to the lower portion of the second area 6 is thicker than the other walls.

In addition, two baffle plates 3 are provided above the partitioning walls 2 so as to incline downward from the first areas 5 on both sides toward the second area 6 at the center. One end of each baffle plate 3 is attached to the side wall of the oil pan main body 1, while the other end thereof extends above the partitioning wall 2 to reach above the second area 6. In addition, a number of upper-communication openings 3*a* are formed in the baffle plate 3 so as to communicate the upper surface side and the lower surface side thereof. The upper communication openings 3*a* possess a flow path resistance that changes a passage state of the oil based on changes in the viscosity in accordance with changes in the temperature of the returning oil from the internal combustion engine that has fallen onto the baffle plate 3. Specifically, a diameter (for example, 2 mm), a pitch, and the like of the upper communication openings are set such that: when the returning oil from the internal combustion engine has a low temperature that is less than a predetermined value (for example, 80° C.) and thus has a high viscosity, the oil does not readily pass through the upper communication openings 3*a*; and in contrast, when the returning oil has a high temperature that is equal to or greater than a predetermined value (for example, 80° C.) and thus has a low viscosity, the oil passes readily through the upper communication openings 3*a*.

In addition, umbrella portions 4 (exemplified as the "cover members" according to the present invention), which incline downward from the second area 6 toward the first areas 5, are provided above the baffle plates 3.

(2) Operations of the Oil Pan Structure

Next, operations of the oil pan structure having the structure described above will be explained.

First, when the oil has a low temperature during, for example, an engine start-up, the low-temperature returning oil, from the internal combustion engine, that has fallen onto the baffle plates 3 does not readily pass through the upper communication openings 3*a* because the viscosity thereof is relatively high. Thus, substantially the entire quantity of the oil flows over the upper surfaces of the baffle plates 3 along the inclines thereof. The oil falls from the end portions of the baffle plates 3 to reach the second area 6 and is drawn into the oil suction opening 7 without transiting the oil cooling portions 1*b*. Then the oil is pumped again to each part of the internal combustion engine.

In contrast, when the temperature of the oil has become high after the warm-up operation, the high-temperature returning oil from the internal combustion engine that has fallen onto the baffle plates 3 has a comparatively low viscosity. Thus, the oil readily passes through the upper communication openings 3 and substantially the entire quantity of the oil falls into the first areas 5. Then, the high-temperature oil that has fallen into the first areas 5 comes into contact with the oil cooling portions 1*b* that are provided at the bottom wall of the oil pan main body 1 so that the heat thereof is dissipated. Subsequently, the oil passes through the lower communication openings 2*a* to reach the second area 6, the oil is drawn into the oil suction opening 7, and is then pumped again to each part of the internal combustion engine.

(3) Effects of the Embodiment

According to the above, in the oil pan structure of the present embodiment, when returning oil from the internal combustion engine has a high temperature, substantially the entire quantity of the oil transits the bottom wall of the oil pan main body 1 and the oil comes into contact with the oil cooling portions 1*b* provided thereat such that the heat thereof is dissipated. Thus, it is possible to efficiently dissipate the heat of the high-temperature oil. In addition, when the returning oil from the internal combustion engine has a low temperature during a start-up, for example, the returning oil from the internal combustion engine is drawn into the oil suction opening 7 without passing through the oil cooling portions 1*b*. At the same time, most of the low-temperature oil that is retained in the first areas 5 does not readily flow into the second area 6, and the circulated quantity of the oil is reduced by prioritizing the circulation of the oil in the second area 6. Thus, it is possible to rapidly raise the temperature of the low-temperature, and to realize the early warm-up of the internal combustion engine. As a result, it is possible to reduce the friction in the engine, as well as to increase the heating performance. Furthermore, switching of the oil flow route is carried out by using the flow path resistance of the upper communication openings 3*a* based on the changes in the temperature of the oil, that is, the changes in the viscosity of the oil. Thus, it is unnecessary to use switching valves and the like. Therefore, it is possible to reduce both the number of parts and the cost so that a simple and inexpensive structure can be realized. In addition, there are no problems related to the operational reliability of a valve.

Furthermore, in the present embodiment, a heat insulating function is provided by making the part of the bottom wall of the oil pan main body 1 that corresponds to the lower portion of the second area 6 thicker than the other part of the wall. Thus, the heat of low-temperature oil is not readily dissipated even after coming into contact with the bottom wall at the lower portion of the second area 6. Therefore, the temperature of the low-temperature oil can be more quickly raised, and thus, it is possible to realize an earlier warm-up of the internal combustion engine.

In addition, in the present embodiment, the heat dissipating fins 1*c* are provided on the outer side of the bottom wall of the oil pan main body 1. Therefore, it is possible to further increase the heat dissipation effect on the high-temperature oil that has come into contact with the bottom wall of the oil pan main body 1.

Furthermore, in the present embodiment, the first areas 5 are provided on both sides of the second area 6, and thus, the oil retaining portion 1*a*, at which the oil suction opening 7 is arranged, is positioned at the center portion of the oil paths (the oil cooling portions 1*b*) that are provided on both sides. Therefore, the oil is readily guided to the oil retaining portion 1*a*.

In addition, in the present embodiment, the umbrella portions 4 are provided above the baffle plates 3. Therefore, the high-temperature returning oil from the internal combustion engine can be prevented from falling directly into the second area 6. Thus, it is possible to reliably guide the high-temperature oil to the oil cooling portions 1*b*.

Figure 2B:
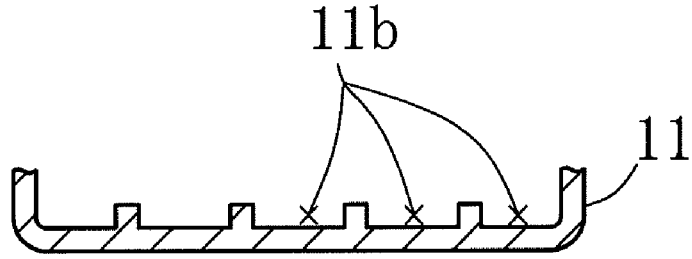

Note that the present invention is not limited to the embodiment described above, and depending on the object and use, various modifications are possible within the scope of the present invention. Specifically, in the above embodiment, the oil cooling portions 1*b* are provided such that the bottom wall of the oil pan main body 1 is recessed from the inside. However, the present invention is not limited to this, and for example, as shown in FIG. 2B, the oil cooling portions 1*b* may be provided so as to project in a ribbed shape in the inward direction. In this case as well, the heat of the high-temperature oil that comes into contact with the bottom wall of the oil pan main body 1 can be efficiently dissipated.

Figure 3A:
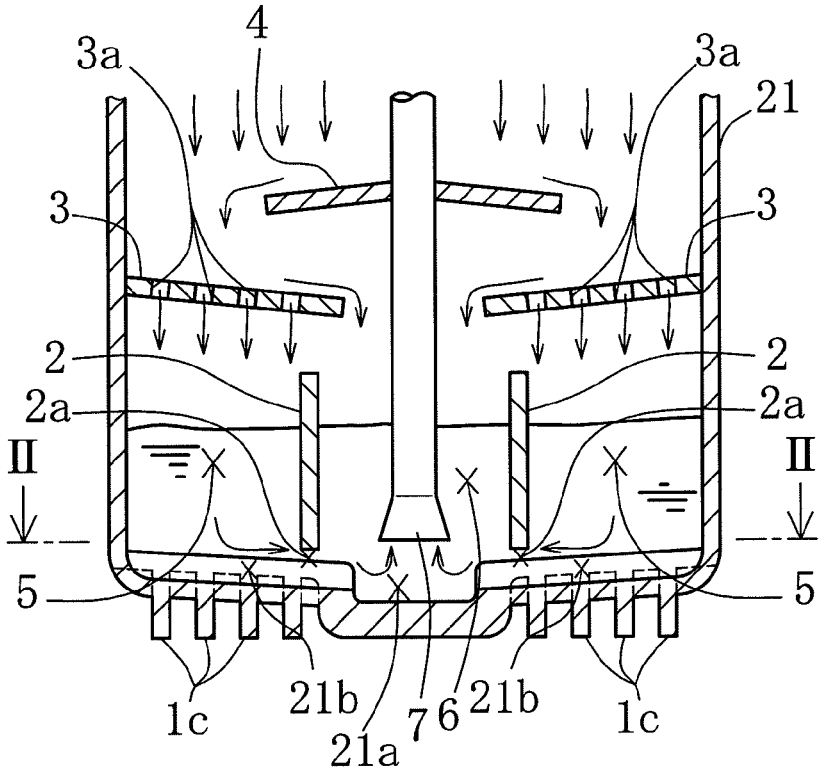
FIG. 3A and FIG. 3B show cross-sectional views of the oil pan structure according to another embodiment, where
Figure 3B:
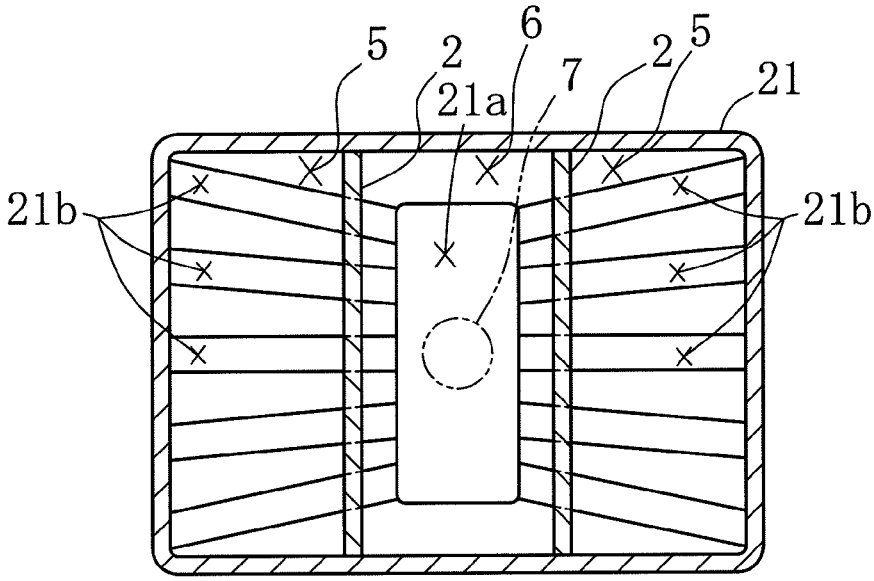

In addition, in the above embodiment, the oil cooling portions 1*b* extend toward the oil retaining portion 1*a* to below the partitioning walls 2. However, the present invention is not limited to this, and as shown in FIGS. 3A and 3B, for example, the oil cooling portions 21*b* may pass under the partitioning walls 2 and extend up to the oil retaining portion 21*a*. In this case, the returning oil from the internal combustion engine that has reached the bottom wall of the oil pan main body 21 can be reliably guided to the oil retaining portion 21*a*.

Figure 4A:
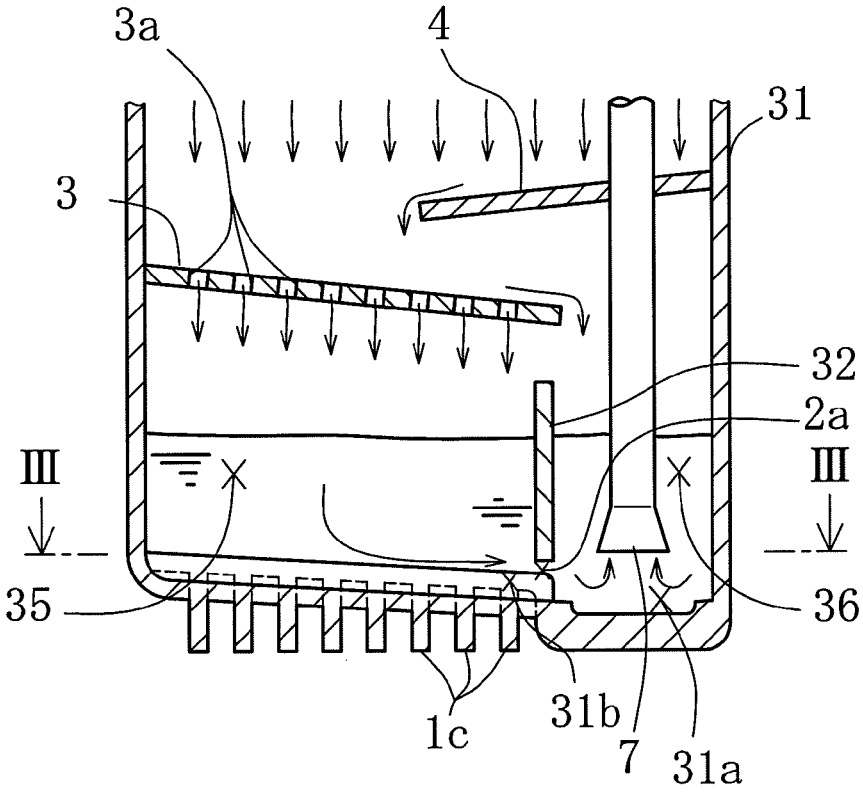
FIG. 4A and FIG. 4B are cross-sectional views of the oil pan structure according to yet another embodiment, where
Figure 4B:
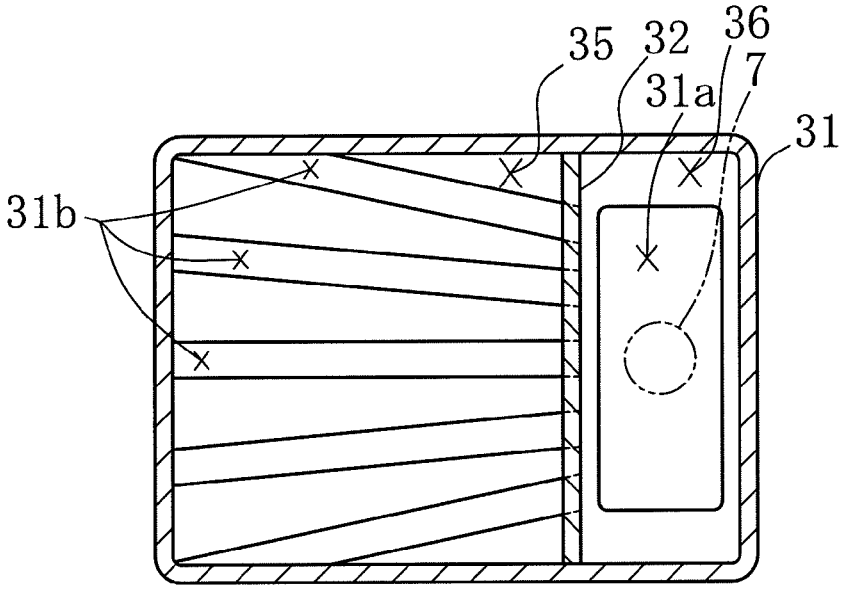
Figure 5A:
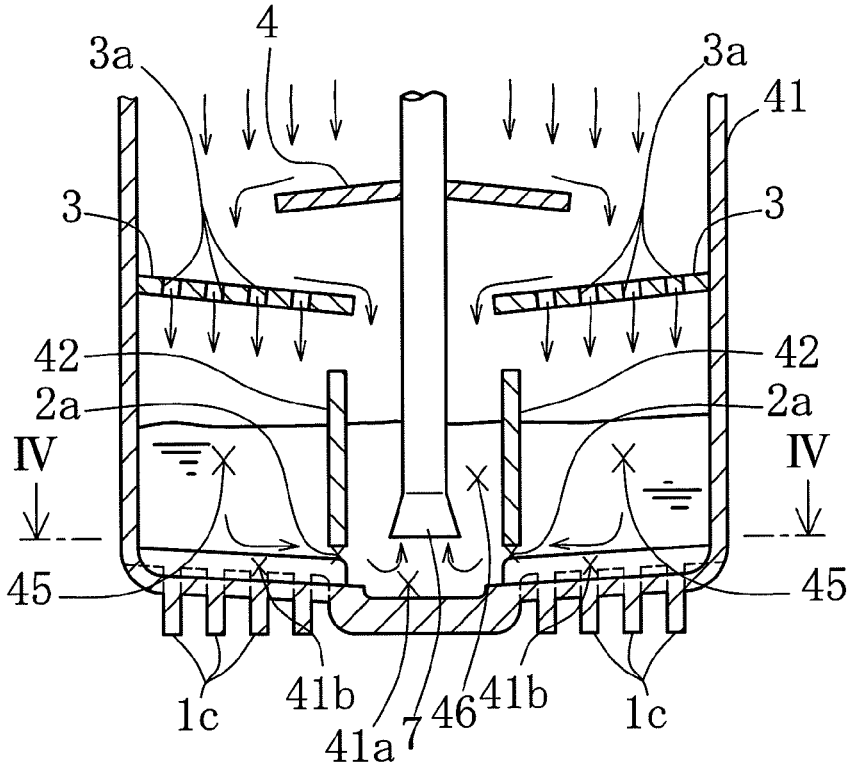
FIG. 5A and FIG. 5B show cross-sectional views of the oil pan structure according to yet another embodiment, where
Figure 5B:
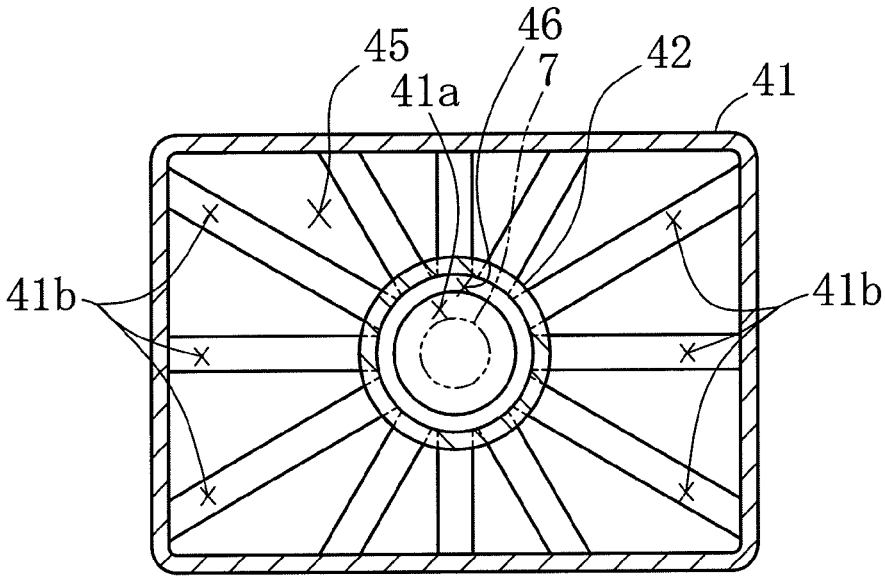

Furthermore, in the above embodiment, the second area 6 is provided at the center and the first areas 5 are provided on both sides thereof by providing two partitioning walls 2 so as to partition the inside of the oil pan main body 1 into three chambers. However, the present invention is not limited to this, and as shown in FIGS. 4A and 4B, for example, one partitioning wall 32 may be provided to partition the inside of the oil pan main body 31 into two chambers, and the first area 35 and the second area 36 may be provided adjacent to each other side by side. In this case, it is possible to simplify the oil pan structure. In addition, as shown in FIGS. 5A and 5B, for example, a cylindrical partitioning wall 42 may be provided to partition the inside of the oil pan main body 41 into a first area 45 on the outside of the partitioning wall 42 and a second area 46 on the inside thereof. In this case, due to the oil paths (the oil cooling portions 41*b*) that spread radially from the oil retaining portion 41*a*, the returning oil from the internal combustion engine that has reached the bottom wall of the oil pan main body 41 gathers from all directions around the oil retaining portion 41*a*. Thus, it is possible to guide the returning oil to the oil retaining portion 41*a* more reliably.

In addition, in the above embodiment, a heat insulating function is provided by making the part of the bottom wall of the oil pan main body 1 that corresponds to the lower portion of the second area 6 thicker than the other part of the bottom wall. However, the present invention is not limited to this, and a heat insulating function may be provided by adopting a double-walled structure or attaching a heat insulating material to the outer surface side. In this case as well, the temperature of the low-temperature oil can be quickly raised, and thus, it is possible to realize the early warm-up of the internal combustion engine. In addition, it is possible to eliminate the heat insulating function at the bottom wall of the lower portion of the second area 6. In this case, it is possible to simplify the oil pan structure.

Furthermore, in the above embodiment, the heat dissipating fins 1*c* are provided on the outer side of the part of the bottom wall of the oil pan main body 1 that corresponds to the lower portions of the first areas 1. However, the present invention is not limited to this, and the heat dissipating fins 1*c* may be provided on the entire surface of the bottom wall of the oil pan main body 1. Also, additional heat dissipating fins 1*c* may be provided on the side wall so that the heat dissipation effect can be further improved.

In addition, in the above embodiment, the umbrella portions are provided above the baffle plates 3. However, the present invention is no limited to this, and a structure may be used that does not have the umbrella portions 4. In this case, it is possible to simplify the oil pan structure.

INDUSTRIAL APPLICABILITY

The present invention can be widely used as an oil pan structure for an internal combustion engine or a general-use machine having, at a lower portion thereof, an oil pan that retains oil returning from lubricated portions. In particular, the present invention is suitable for an oil pan structure of a wet sump engine for a vehicle.

What is claimed is:

1. An oil pan structure, comprising:

an oil pan main body;

a partitioning wall that is provided inside said oil pan main body and that partitions the inside of said oil pan main body into a first area and a second area; and a plate-shaped baffle plate that is provided inside said oil pan main body at least above said first area, a first end of said baffle plate connected to said oil pan main body, and said baffle plate extending inwardly from said oil pan main body and terminating at a second free end of said baffle plate, wherein said baffle plate inclines downward from said first end to said second free end; wherein an oil retaining portion is provided at a part of a bottom wall of said oil pan main body, which is a lower portion of said second area at which an oil suction opening is arranged;

an oil cooling portion is provided at a part of said bottom wall of said oil pan main body, which is a lower portion of said first area;

an upper communication opening that communicates an upper surface side and a lower surface side of said baffle plate is provided in said baffle plate; and a lower communication opening is provided at a lower end side of said partitioning wall, said lower communication opening communicating said first area and said second area as well as causing oil that has fallen into said first area after passing through said upper communication opening to flow into said second area via said oil cooling portion.

2. The oil pan structure according to claim 1, wherein said oil cooling portion includes a groove portion that extends from said first area toward said oil retaining portion.

3. The oil pan structure according to claim 1, wherein a part of said bottom wall that corresponds to said second area has a heat insulating function.

4. The oil pan structure according to claim 1, wherein a ribbed heat dissipating plate is provided on an outer side of said bottom wall.

5. The oil pan structure according to claim 4, wherein said heat dissipating plate is provided on an outer side of a part of said bottom wall that corresponds to said lower portion of said first area.

6. The oil pan structure according to claim 1, wherein said first area is provided at least on both sides of said second area.

7. The oil pan structure according to claim 1, wherein a cover member is provided above said baffle plate inside said oil pan main body so as to cover a space above said second area.

8. The oil pan structure according to claim 7, wherein said cover member inclines downward from said second area toward said first area.

9. The oil pan structure according to claim 2, wherein a part of said bottom wall that corresponds to said second area has a heat insulating function.

10. The oil pan structure according to claim 9, wherein a ribbed heat dissipating plate is provided on an outer side of said bottom wall.

11. The oil pan structure according to claim 10, wherein said heat dissipating plate is provided on an outer side of a part of said bottom wall that corresponds to said lower portion of said first area.

12. The oil pan structure according to claim 11, wherein said first area is provided at least on both sides of said second area.

13. The oil pan structure according to claim 12, wherein a cover member is provided above said baffle plate inside said oil pan main body so as to cover a space above said second area.

14. The oil pan structure according to claim 13, wherein said cover member inclines downward from said second area toward said first area.

15. The oil pan structure according to claim 2, wherein said first area is provided at least on both sides of said second area.

16. The oil pan structure according to claim 15, wherein a cover member is provided above said baffle plate inside said oil pan main body so as to cover a space above said second area.

17. The oil pan structure according to claim 16, wherein said cover member inclines downward from said second area toward said first area.

18. The oil pan structure according to claim 17, wherein a cover member is provided above said baffle plate inside said oil pan main body so as to cover a space above said second area.

19. The oil pan structure according to claim 18, wherein said cover member inclines downward from said second area toward said first area.

* * * * *